United States Patent [19]

Lee

[11] Patent Number: 4,669,378

[45] Date of Patent: Jun. 2, 1987

[54] MULTIPLE SCREEN PRINTER WITH SIMULTANEOUS PRINTING

[76] Inventor: Aaron Lee, 379 Cliff St., Fairview, N.J. 07022

[21] Appl. No.: 766,810

[22] Filed: Aug. 19, 1985

[51] Int. Cl.[4] ..... B41F 15/04; B41F 15/10; B41F 15/36

[52] U.S. Cl. ..... 101/115; 101/126

[58] Field of Search ..... 101/115, 126

[56] References Cited

U.S. PATENT DOCUMENTS

| | | | |
|---|---|---|---|
| 1,029,544 | 6/1912 | Horvath | 101/115 |
| 2,485,289 | 10/1949 | Jáne | 101/115 |
| 2,690,118 | 9/1954 | Schwartz et al. | 101/115 |
| 3,427,964 | 2/1969 | Vasilantone | 101/115 |
| 4,084,504 | 4/1978 | Fuchs | 101/115 |
| 4,583,458 | 4/1986 | Beachum | 101/115 X |

FOREIGN PATENT DOCUMENTS

| | | | |
|---|---|---|---|
| 1460782 | 3/1969 | Fed. Rep. of Germany | 101/115 |
| 306511 | 3/1930 | United Kingdom | 101/115 |

*Primary Examiner*—Clifford D. Crowder

*Attorney, Agent, or Firm*—Howard Cohen

[57] ABSTRACT

A multiple screen printing apparatus includes a fixed shaft extending upwardly from a base, and a lower rotatable shaft secured concentrically about a lower portion of the fixed shaft. A plurality of platen supporting assemblies extend radially outwardly from the lower rotatable shaft and are spaced at equal angles thereabout. An upper rotatable shaft is secured concentrically about an upper portion of the fixed shaft, and a disc-like table is secured thereto for rotation therewith. A spindle shaft extends upwardly from the top end of the fixed shaft, and a plurality of screen support arm assemblies extend radially outwardly therefrom for independent rotation thereabout. Each of the screen support arm assemblies includes an arm mounting bracket resting on the rotatable table, and clamping means secures the bracket to the table in an angularly adjustable fashion. Each of the platen supporting assemblies includes an alignment gate for engaging a screen in the printing position and angularly aligning the screen precisely with the respective platen.

14 Claims, 4 Drawing Figures

MULTIPLE SCREEN PRINTER WITH SIMULTANEOUS PRINTING

BACKGROUND OF THE INVENTION

In recent years the screen printing industry has undergone enormous growth, due primarily to the great popular appeal of shirts, caps, jackets, and other apparel bearing printed designs and logos. The screen printed apparel business continues to expand, providing opportunities for thousands of print shops across the country.

Generally speaking, most printed apparel displays a multi-color image, and thus requires multiple printing steps employing color separation images printed in accurate alignment. There are two broad categories of printing machines which are capable of multiple screen printing; manually operated machines, which typically exhibit low output rates, and fully mechanized, automatic printing machines which typically have very high printing rates. However, automatic screen printing machines require a very large capital investment, and also require extensive set-up time and maintenance. In the apparel market, many items are printed in small lots, and thus are not suitable for automatic machine printing. When these small lots are printed on a manual machine, the slow output rate and higher labor factor causes the overall cost to increase.

A typical manually operated multiple screen printing machine known in the prior art provides a plurality of screens bearing the color separation images, each of the screens supported on an individual screen arm. All of the screen arms extend from a rotatable table, and are spaced in supposedly equal angular fashion about the axis of rotation. A plurality of printing platens are disposed below the screens, the platens also being supported by a rotating table having a common axis with the screen table. The platens are also spaced in supposedly equal angular increments about the rotational axis.

With one worker stationed adjacent to each of the platens, it should be possible for all of the workers to pull down the screens simultaneously, ink and print the images, and then lift the screens. The workers should then be able to rotate the platens to the next printing station, and reiterate the printing process. Several manual printing machines currently being sold claim to be able to carry out this high output form of manual printing.

Unfortunately, this high speed mode of printing requires that all of the screens and all of the platens are spaced in perfect equal angular fashion. If one of the platens or one of the screens arms are spaced out of tolerance, even by a fraction of a degree, that screen or platen will not register with its respective platen or screen during the printing operation. Although the two components may be forced manually into registration, the common table mounting of the platens and the screens will cause all of the coupled components to tend to shift angularly as the out of tolerance component is forced into alignment. The result is a printed image in which the color separations are not in accurate alignment, and the article is not suitable for sale.

It is an empirical fact that equal angular spacing of multiple components on a large radius assembly is difficult to achieve and sustain. Slight angular misalignments in multiple screen printing machines are almost unavoidable. Thus, in the prior art many manually operated screen printing machines which claim to provide high speed, simultaneous printing are actually operated in serial printing fashion: each screen is pulled down and printed individually and separately from the others. The obvious consequence is that the printing output rate is far lower than advertised by the printing machine manufacturer.

SUMMARY OF THE PRESENT INVENTION

The present invention generally comprises a multiple screen printing apparatus adapted for manual operation which is particularly designed for high speed, simultaneous printing of all screens. The present invention provides for higher printing output rates than prior art manually operated machines, yet involves no more expense or setup time.

The multiple screen printing apparatus includes a fixed shaft extending upwardly from a support base, and a lower rotatable shaft secured concentrically about a lower portion of the fixed shaft. A plurality of platen supporting assemblies extend radially outwardly from the lower rotatable shaft and are spaced at equal angles thereabout. An upper rotatable shaft is secured concentrically about an upper portion of the fixed shaft, and a disc-like table is secured thereto for rotation therewith. A spindle shaft extends upwardly from the top end of the fixed shaft, and a plurality of screen support arm assemblies extend radially outwardly therefrom in independently rotatable fashion.

Each of the screen support arm assemblies includes an arm mounting bracket supported by the rotatable table, and clamping means for securing the bracket in the table includes an angular adjustment clearance to accommodate any angular misalignments about the common axis of rotation. Each of the platen supporting assemblies includes an alignment gate for engaging a screen in the printing position and angularly aligning the screen precisely with the respective platen. The alignment of each screen with a platen disposed therebelow is substantially independent of the other screens, so that simultaneous printing of all screens may be achieved.

DESCRIPTION OF THE PREFERRED EMBODIMENT

The present invention generally comprises a screen printing apparatus which is particularly adapted for printing multiple color separation images on an article such as an item of wearing apparel. A significant aspect of the invention is that a plurality of printing screens are provided by the apparatus, and all of the screens may be used simultaneously to print a plurality of items which are rotated serially beneath the printing screens. Although the apparatus described as the preferred embodiment is operated by manual effort, it is capable of printing output rates comparable to fully mechanized, automatic screen printing devices.

Figure 2:
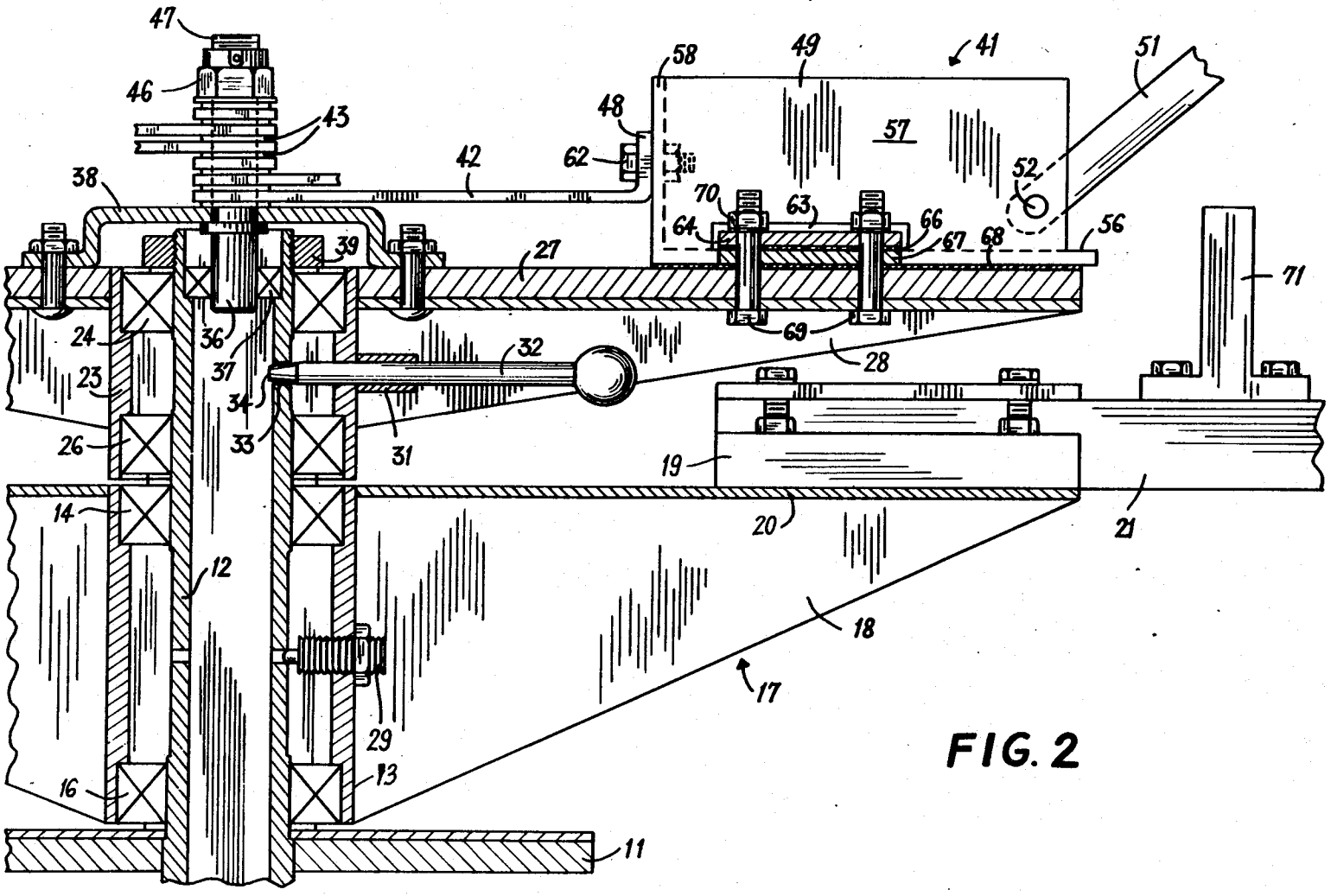
FIG. 2 is a partial front elevation of the multiple screen printer of the present invention.

With regard to the accompanying Figures, and in particular FIG. 2, the preferred embodiment includes a floor-engaging base structure 11 from which a stationary, tubular central shaft 12 extends vertically upwardly. The base structure forms no independent part of the invention, and may comprise any rigid base arrangement known in the prior art. Secured concentrically about the lower and medial portions of the tubular shaft 12 is a lower rotating tubular shaft 13. A pair of roller bearings 14 and 16 at opposed ends of the tubular shaft 13 are supported on the fixed shaft 12 and provide support for the shaft in freely rotating fashion.

Figure 1:
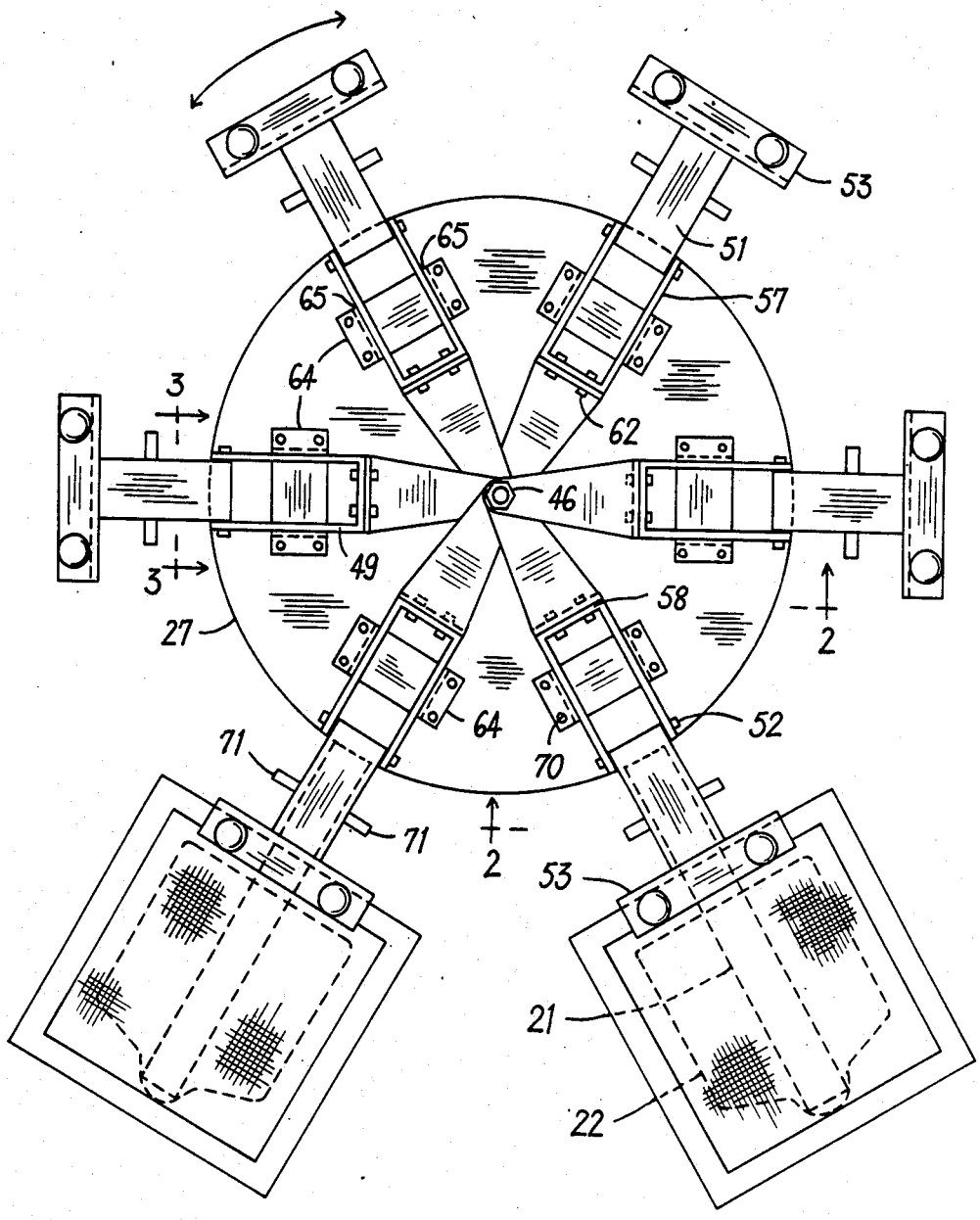
FIG. 1 is a top plan view of the multiple screen printer of the present invention.

Joined to the outer peripheral surface of the rotatable tubular shaft 13 is a plurality of supporting assemblies 17. Each of the assemblies 17 comprises a support web 18, a generally planar, right triangular member disposed in a vertical plane and having one edge extending vertically and welded to the outer surface of the shaft 13. The upper, horizontally extending edges of the members 18 are joined to a disk-like table 20 extending radially from the outer tubular shaft 13. A plurality of bracket members 19 are disposed on the upper surface of the table 20, arrayed at the periphery in equal angular spacing fashion and welded thereto. A beam 21 is bolted to each bracket 19, and extends radially outwardly with respect to the shaft assembly 12 and 13. At the distal end of the beam 21, a printing platen 22 is secured in a generally horizontal disposition, as shown in FIG. 1.

In a typical printing apparatus, four, six or eight platen supporting assemblies 19–22 are provided, although the number is not significant with respect to the functioning of the apparatus. Also, the platen 22 may comprise a shirtboard, a capboard, or any other apparel printing platen known in the prior art. A detent mechanism 29, such as a ball detent assembly known in the prior art, extends between the rotatable shaft 13 and the fixed shaft 12, with a plurality of detent positions formed on the outer surface of the tubular shaft 12, spaced equally about the rotational axis and equal in number to the number of printing platens.

Returning to FIG. 2, the present invention also includes an upper rotating tubular shaft 23 secured concentrically about the upper portion of the tubular shaft 12 and supported thereon by a pair of roller bearings 24 and 26. A disc-like table 27 extends radially outwardly from the upper end of the tubular shaft 23, and is supported thereon for rotatable motion in concert therewith. Extending between the outer peripheral surface of the tubular shaft 23 and the bottom surface of the table 27 is a plurality of supporting web members 28. Each of the members 28 comprises a planar, triangular member similar in form and function to the members 18 and smaller in the vertical dimension.

The table 27, the supporting members 28, and the shaft 23 are adapted for rotation about the central, fixed tubular shaft 12. However, it is necessary to immobilize the table 27 during some printing procedures, as described in the following. For this purpose, the present invention provides a sleeve 31 extending radially from the shaft 23 and aligned with a radial hole formed therein. A locking pin 32 is slidably received in the sleeve 31 and provided with a tapered end 34. One or more holes 33 are formed in the tubular fixed shaft 12, and disposed to be engaged by the tapered end of the locking pin 32. It may be appreciated that the pin may be slidably inserted into any of the holes 33 to selectively immobilize the table 27 and the shaft 23, and may be equally easily removed from rotating the table 27.

Joined to the threaded upper end of the tubular shaft 12 is a collar-like adjustment nut assembly 39. The nut 39 joins the vertical stack formed by the rotating tubular shafts 13 and 23, together with the associated support bearings. It may be appreciated that the nut 39 may be tightened to exert a compressive frictional force on the stacked column and selectively adjust the freedom of rotation of the platens extending from the table 20 or of the support table 27.

A significant feature of the present invention is the provision of a spindle shaft 36 extending upwardly from the upper end of the fixed shaft 12 and disposed coaxially therewith. The lower end of the spindle shaft 36 is supported by a bearing 37 secured within the upper end portion of the shaft 12. A flanged cup 38 is secured to the rotatable table 27, and includes an opening through which the spindle shaft extends upwardly. The flanged cup 38 is centered with respect to the axis of the shaft assembly, and provides support for a medial portion of the shaft 36 so that it cannot wobble or move from its axial alignment.

Figure 4:
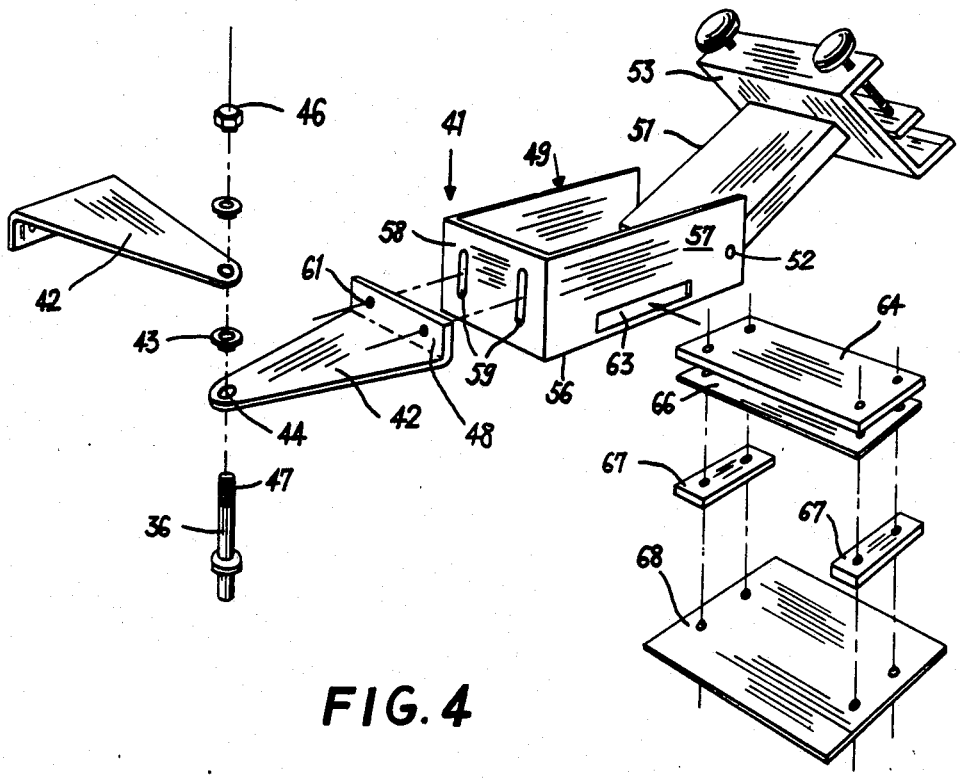
FIG. 4 is an exploded view of the arm supporting structure of the multiple screen printing apparatus of the present invention.

The spindle shaft is particularly provided to support a plurality of printing screen arm mounting assemblies 41, as shown in FIGS. 1, 2, and 4. Each arm mounting assembly includes a strut 42, comprising a triangular, planar member having a hole 44 extending through the apex portion thereof. A plurality of flange bushings 43 are also provided, each including a sleeve-like central portion havng an aperture dimensioned to receive the shaft 36 therethrough. The sleeve-like portion is received in the hole 44 of one of the struts 42 to provide a bearing surface so that each strut may rotate about the shaft 36 without undue wear. The flange portion of each bushing 43 creates a vertical separation between each of the adjacent struts 42 in the vertically stacked arrangement in which they are disposed. A cap nut 46 secured to the upper threaded end 47 of the shaft 36 secures the struts 42 on the shaft.

Each of the struts 42 includes a flange 48 extending generally orthogonally from the plane thereof and disposed at the outer radial extent thereof. An arm mounting bracket 49 is adapted to be secured to the flange 48, and an arm 51 is joined to the distal end portion of the bracket 49 by a pivot shaft 52. A clamp 53 secured to the distal end of the arm 51 is adapted to secure a printing screen bearing an image, or a color separation image, which is to be imparted to an item supported on one of the platens 22. The depiction of the arm 51 and the clamp 53 are for exemplary purposes only; there are many forms and refinements of support arms and clamps known in the prior art which may be incorporated herein, but they form no independent part of the invention and are not described.

Figure 3:
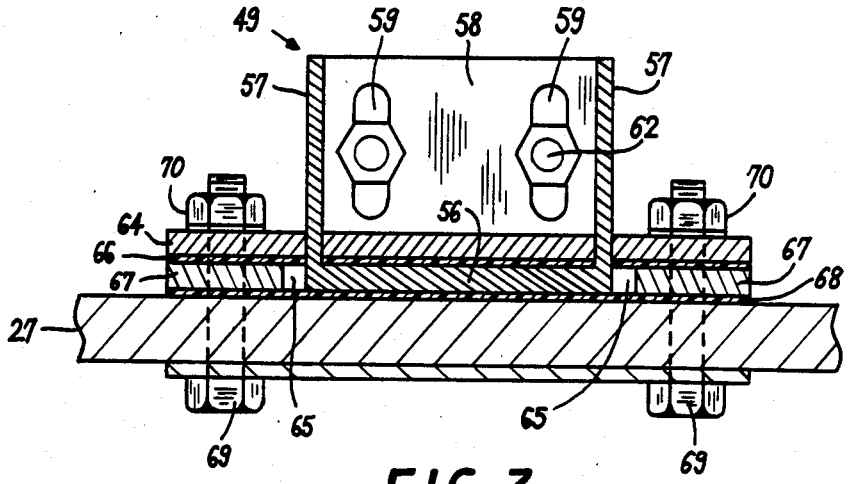
FIG. 3 is an enlarged cross-sectional elevation of the arm supporting structure of the present invention, taken along line 3—3 of FIG. 1.

It is significant to note that each of the arm mounting brackets 49 is supported by the table 27, as shown in FIG. 3, yet the brackets 49 are each connected to one of the plurality of identically formed struts 42 having a differing vertical position on the shaft 36. Each of the brackets 49 comprises a box frame having a base plate 56 impinging on the table 27, a pair of side walls 57, and a proximal end wall 58 disposed in orthogonal relationship. A pair of vertically extending slots 59 in the end wall 58 are disposed in registration with a pair of mounting holes 61 in the flange 48 of one of the struts 42. A pair of bolts extend through the holes 61 and slots 59 to secure the bracket 49 to the strut 42, the slots 59 providing the vertical adjustment necessary to acommodate the differing vertical positions of the struts. In addition, the several struts 42 at the upper portion of the vertical stack are inverted, with the flange 48 thereof extending downwardly, as shown in FIG. 4, to increase the range of vertical adjustment without increasing the size of the components.

In one mode of operation of the present invention, the printing frame art support assemblies are constrained to rotate within a small angular excursion to permit registration of the printing screen with a platen rotated into position therebelow, as will be detailed later in the specification. Each of the arm mounting brackets 49 include a pair of slot openings 63 extending through the sidewalls 57 adjacent to the base plate 56. A plate 64 and a low friction bearing sheet 66 are dimensioned to extend through the slots 63 with substantial clearance, and are supported by spacers 67 disposed laterally outwardly of the nominal position of the bracket 49.

Another low friction bearing sheet 68 is interposed between the base plate 56 of the bracket 49 and the upper surface of the table 27. A plurality of bolts 69 extend upwardly from the table 27, and are disposed to secure the bearing pads, spacers, and plate 64 to the table. It should be noted that the bolts and spacers are spaced apart wider than the bracket 49, to provide a lateral clearance space 65 in which the bracket may be selectively positioned by rotation of the corresponding strut 42 through small angular excursions. The bracket 49 slidably engages the pads 66 and 68, which are formed of a low friction, durable material such as Nylon, Teflon, or the like. The nuts 70 may be tightened on the bolts 69 to compressively clamp the assembly to the table 27, thus providing selective frictional control of the angular movement of the printing frame arm support assemblies with respect to the support table 27.

It should be noted that each of the beams 21 which support a printing platen 22 also include a guide bracket or registration gate 71 supported medially between the platen and the bracket 19, as shown in FIGS. 1 and 2. The gate 71 extends upwardly from laterally opposed sides of the beam, and is sufficiently wide to engage the arm 51 of an assembly 41 with minimal lateral clearance. Thus when the arm 51 is rotated downwardly from the quiescent position shown in FIG. 4, it is guided by the gate 71 into precise registration with the item supported on the platen. In this manner color separated images may be aligned precisely to provide an integrated, multi-colored image of any desired complexity. The clamping assembly 64–70 permits the table 27 to support the printing screen assemblies while providing a means for self-adjustment of the position of each screen-supporting arm with respect to the detented position registration gate of the platen, thus ensuring registration of the arms 51 with the gates 71 of the respective platens 22.

It may be appreciated that each of the screen supporting arm assemblies may be set at a desired angular spacing with respect to the adjacent arm assemblies, and the entire table 27 may be rotated in common with the arm assemblies to present successive screens to a particular platen disposed in a fixed printing position. When all the screens have been printed, the platen may be rotated to an article removal station, while another platen is rotated from an article placement station to the fixed printing position. This printing procedure, known in the prior art, may be performed by a minimum number of workers, but it is rather slow in terms of output rate.

A preferred mode of operation of the present invention involves employing the locking pin 32 to secure the table 27 at an angular location in which each of the screen arm supporting assemblies is disposed directly in registration with a detented printing position of one of the platens 22. One worker is stationed at each of the printing positions, and is required manually to pull down the same screen onto a platen and ink the respective image onto the article supported thereon. All of the workers may pull their respective screens down simultaneously, ink the image to form a print thereof, release the screen upwardly, and then rotate all of the platens simultaneously to present the next successive platen to each printing station. At one of the stations a worker strips the platen and places the fully printed article on a drying device, while at the serially adjacent station another worker loads a fresh article onto the empty platen. In this manner a group of workers may achieve output rates substantially equal to fully mechanized, automatic screen printing machines, without incurring the large capital expense of such machines and without requiring the long setup time typical of such devices.

The critical factor which permits simultaneous printing with the present invention is the independently rotatable support of each of the screen support arm assemblies 41 by the spindle shaft 36, together with the "floating" support of each of the arm supporting brackets 49 by the table 27. These features permit the independent adjustment of the angular spacing of the screen support arm assemblies, so that each screen may be aligned with the detented position of the platen rotated therebelow. Furthermore, the floating support permits slight independent angular movement of each screen as it is rotated downwardly into the respective alignment gate, so that each screen is self-aligning without affecting the angular position of the other screens. This feature has never been found in the prior art.

Although the preferred embodiment of the present invention has been described with reference to a manually operated printing machine, it may be appreciated that the underlying concepts of the invention may also be applied to automated printing machines. Furthermore, the present invention is not limited to the printing of apparel articles, but may be used in printing any screen printed item.

I claim:

1. A multiple screen printing apparatus, including: a support base, first rotating means extending upwardly from said base, a plurality of platen supporting means extending radially outwardly from said first rotating means, second rotating means extending upwardly from said base, a plurality of printing screen assemblies extending radially outwardly from said second rotating means, means for securing each of said printing screen assemblies to said second rotating means in independently rotatable fashion, means for supporting each of said printing screen assemblies at the distal ends thereof, including third rotating means extending upwardly from said base, and a support table secured to said third rotating means and extending generally radially outwardly therefrom.

2. The apparatus of claim 1, wherein said support base includes a fixed shaft extending upwardly therefrom, and said first, second, and third rotating means include rotating shafts secured to said fixed shaft and adapted for coaxial rotation with respect thereto.

3. The apparatus of claim 1, wherein said plurality of platen supporting means are spaced at equal angles about the axis of rotation of said first rotating means.

4. The apparatus of claim 1, wherein said second rotating means includes a spindle shaft extending from a fixed portion of said support base.

5. The apparatus of claim 4, wherein each of said plurality of printing screen assemblies includes a strut member extending from said spindle shaft and secured thereabout for independent rotation.

6. The apparatus of claim 5, wherein each of said plurality of printing screen assemblies includes screen clamping means for supporting a printing screen, an arm member extending from said clamping means, and an arm supporting bracket secured to said strut member and adapted to support said arm member in rotatable fashion about an axis orthogonal to said spindle shaft.

7. The apparatus of claim 6, further including means for supporting the radially distal portions of said printing screen assemblies.

8. The apparatus of claim 7, wherein said last mentioned means includes a support table disposed subjacently of said radially distal portions of said printing screen assemblies, and third rotating means for supporting said support table in independently rotatable fashion.

9. The apparatus of claim 8, wherein said third rotating means and said spindle shaft are disposed in coaxial alignment.

10. The apparatus of claim 8, wherein said support table includes means for engaging each of said arm support brackets in supporting fashion.

11. The apparatus of claim 10, wherein said last mentioned means includes a plurality of bracket clamping means, each adapted to secure one of the arm supporting brackets to said support table with independently adjustable, limited angular clearance about the axis of rotation of said spindle shaft.

12. The apparatus of claim 7, further including means for selectively immobilizing said third rotating means to lock said support table in a desired annular position.

13. The apparatus of claim 1, further including detent means for selectively and releasably securing said first rotating means in any of several desired angular positions.

14. The apparatus of claim 1, further including means for aligning each of said printing screen assemblies with a respective one of said platen supporting means independently of the alignment of the remaining printing screen assemblies with their respective platen supporting means.

* * * * *